United States Patent [19]

Taipalus

[11] 4,210,363

[45] Jul. 1, 1980

[54] PORTABLE CONTAINER SEAT

[76] Inventor: Larry R. Taipalus, 29037 Barton, Garden City, Mich. 48135

[21] Appl. No.: 2,324

[22] Filed: Jan. 10, 1979

[51] Int. Cl.[2] ..... A47C 9/10

[52] U.S. Cl. ..... 297/192; 190/42; 190/8; 190/41 Z

[58] Field of Search ..... 190/412, 42, 1, 8; 297/192, 461, 217; 220/902, 408

[56] References Cited

U.S. PATENT DOCUMENTS

| | | | |
|---|---|---|---|
| 609,696 | 8/1898 | Nicalle | 190/8 |
| 1,734,587 | 11/1929 | Lowe | 190/41 Z |
| 2,607,946 | 8/1952 | Price | 297/192 |
| 2,649,999 | 8/1953 | Burch | 220/468 |
| 2,684,135 | 7/1954 | Carr | 190/41 Z |
| 3,263,246 | 8/1966 | Towery | 190/42 |
| 3,842,977 | 10/1974 | Hollander | 190/41 Z |
| 4,067,607 | 1/1978 | Battles | 297/192 |

FOREIGN PATENT DOCUMENTS

| | | | |
|---|---|---|---|
| 114985 | 12/1900 | Fed. Rep. of Germany | 190/42 |

*Primary Examiner*—Herbert F. Ross

*Attorney, Agent, or Firm*—Willis Bugbee

[57] ABSTRACT

An elongated stiff tubular body of preferably heat-insulating material, such as cardboard, has a flexible plastic cover which is held in place at its upper end between a pair of discs interconnected by fasteners. The upper disc forms the base of a cushion of flexible padding within a flexible plastic cover. The plastic cover of the body is reversely bent around the lower end thereof and is clamped within the interior thereof by a tubular clamping member which also holds in place the upwardly-bent peripheral portion of a flexible closure of sheet material equipped with an arcuate opening closed by a circular slide fastener. A grooved base ring encircles the lower end of the body and its cover. Also held in place between the lower disc at the top of the body and the tubular clamping member at its lower end is a hollow cylindrical coating or wall of heat-insulating material, such as foam plastic. A carrying strap is secured to the body near its opposite ends for placing over the usual shoulder. A hollow cylindrical lining of heat-insulating material, such as foam plastic, is secured within the body.

10 Claims, 4 Drawing Figures

PORTABLE CONTAINER SEAT

BACKGROUND OF THE INVENTION

Hitherto there have been provided for motorists, picnickers, sportsmen, campers and hunters drum-shaped stools with top openings and covers or side opening with doors. None of these known to the present inventor discloses a hollow cylindrical seat with a fixed cushion at the top and an opening at the bottom with a closure equipped with a circular slide fastener for inserting in the hollow interior articles such as fishing tackle, food, clothing and other desired articles, and none shows a heat-insulating lining for the hollow cylindrical body.

Figure 1:
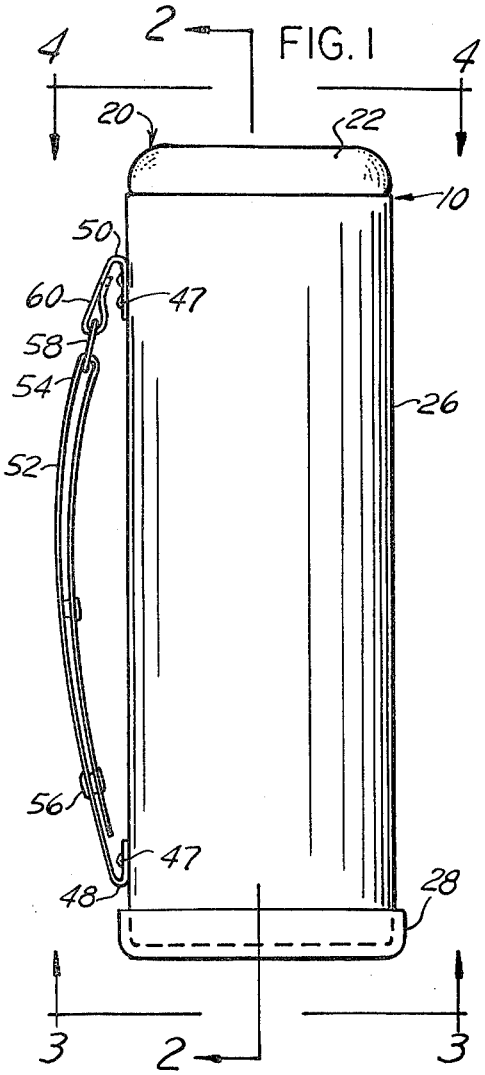
FIG. 1 is a side elevation of the container seat of this invention.

Referring to the drawing in detail, this seat 10 is in the form of a hollow drum, which also serves as a container for various articles such as food, or even wet bathing suits. The seat 10 consists of an elongated stiff hollow cylindrical body 12 of heat-insulating material such as cardboard like that used for shipping tubes, one successfully build and used being approximately nine inches in diameter but preferably larger in diameter. The upper end of the body 12 is closed by an upper closure structure 15 including a disc 14 to which is secured as by the fastener 16 another disc 18 forming the base of a cushion 20 having a flexible vinyl plastic covering 22 enclosing padding 24 and together forming an upper closure structure 25. The cylindrical body 12 is also covered by a flexible vinyl plastic covering 26 of the same material as the covering 22.

A grooved annular plastic member or seat rest 28 receives the lower end of the cylindrical body 12 to aid in supporting it as well as spacing it off the ground and adapting it to rest upon uneven ground without wobbling. The bottom of the body 12 has a flexible lower closure structure 30 of the same material as the coverings 22 and 26. The lower closure structure 30 (FIG. 3) includes a substantially circular central portion or flap 31 and a separate annular portion 33 interconnected by a neck portion 35 and by a circularly arcuate slide fastener 34 closing the arcuate opening 37 therebetween.

Figure 2:
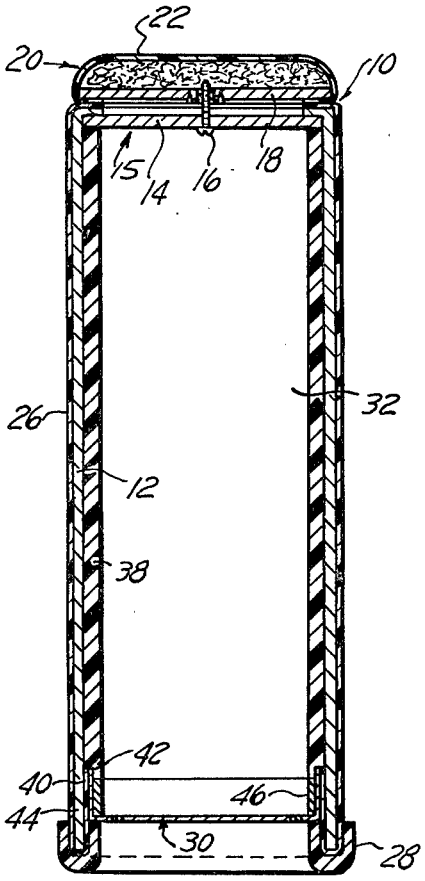
FIG. 2 is a longitudinal section on the line 2—2 in FIG. 1.

Access to the interior compartment 32 of the seat 10 through the closure structure 30 is gained by the slide fastener 34 operated by a conventional slider 36. Also provided is a hollow cylindrical liner 38 of polystyrene foam plastic which not only serves as a waterproof lining but also as a hot or cold insulating layer. The reversely-bent lower end portion 40 of the covering 26 (FIG. 2) and the upturned peripheral portion 42 of the flexible closure 30 are frictionally and, if desired, adhesively secured to the lower end 44 of the hollow cylindrical body 12 by a tubular clamping member 46 tightly pressed into said lower end 44. Secured as by rivets 47 to the upper and lower portions of the body 12 are opposite lower and upper ends 48 and 50 of a carrying strap 52. The latter is provided at its upper end with a lower loop 54 and near its lower end with a snap fastener 56. The lower loop 54 passes through a buckle 58 on the short separate upper loop 60 on the upper end 50 of the carrying strap 52.

Figure 3:
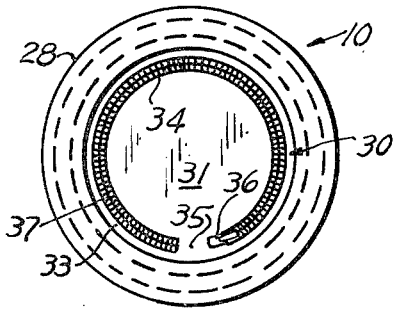
FIG. 3 is a bottom plan view with the carrying strap omitted, taken along the line 3—3 in FIG. 1.
Figure 4:
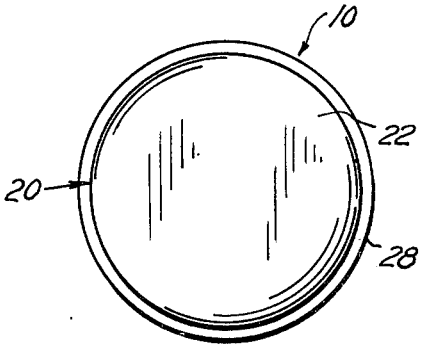
FIG. 4 is a top plan view taken along the line 4—4 in FIG. 1.

The operation of the container seat 10 of the present invention is believed to be self-evident from the foregoing description of its construction, To insert any desired articles or equipment into the chamber 32, the user inverts the container seat 10 and then operates the circular slide fastener 34 by moving the slider 36 in its almost circular path shown in FIG. 3. With the completion of the filling of the chamber 32, the user reverses the foregoing procedure by moving the slider 36 of the slide fastener 34 in a reversely-arcuate path to close the opening provided by the slide fastener. The operator then turns the container seat right-side up and inserts his arm through the carrying strap 52 and carries the seat and its contents like a haversack. When he uses the seat 10 as a stool on the ground, he places the grooved plastic bottom ring 28 which, if the ground is uneven, adapts itself thereby because of its open-centered annular zone of contact therewith. To remove articles from the chamber 32, the user again opens the flexible closure 30 by again operating the slide fastener 34 in the above-described manner.

I claim:

1. A portable container seat, comprising an elongated stiff vertically-disposed hollow cylindrical container body having upper and lower end portions with openings therein, a circular upper end closure structure secured to said upper end portion of said body in closing relationship to said upper end opening, said upper end closure structure including a circular seat cushion thereon and extending across said upper end opening, a circular lower-end closure structure disposed adjacent but in spaced relationship to said lower end portion in openable closing relationship to said lower end opening, said lower end closure structure including an open-centered marginal member and a separate central member and means releasably securing said central portion to said marginal portion, and means for securing said lower end closure structure to said lower end portion of said body.

2. A portable container seat, according to claim 1, wherein said marginal member is substantially annular and said central member is substantially circular, and wherein said releasably securing means includes a circularly-arcuate slide fastener.

3. A portable container seat, according to claim 1, wherein an annular container seat rest is secured to said lower end portion of said body in supporting relationship thereto.

4. A portable container seat, according to claim 3, wherein said seat rest is substantially annular with an annular recess therein receiving said lower end portion of said body.

5. A portable container seat, according to claim 1, wherein said body is formed of heat-conduction resistant material.

6. A portable container seat, according to claim 1, wherein a heat-insulating liner of substantially hollow cylindrical configuration is secured to said body on the inner side thereof in telescoping relationship therewith.

7. A portable container seat, according to claim 6, wherein said heat-insulating liner is composed of foam plastic insulating material.

8. A portable container seat, according to claim 1, wherein said open-centered marginal portion is of substantially annular configuration, wherein said central portion is of incompletely circular configuration, and wherein a neck portion connects said central portion to said annular portion at the incompletely circular portion.

9. A portable container seat, according to claim 8, wherein a circularly arcuate slide fastener separably connects the remainder of said central portion to said open-centered marginal portion.

10. A portable container seat, according to claim 1, wherein said means for securing said lower end closure structure to said lower end portion of said body includes a cylindrical flange on the periphery of said lower end closure structure disposed in telescoping relationship to said lower end portion of said body and secured thereto.

* * * * *